United States Patent [19]

Nystrom

[11] 3,999,388

[45] Dec. 28, 1976

[54] POWER CONTROL DEVICE

[75] Inventor: Per Henrik Gosta Nystrom, Borensberg, Sweden

[73] Assignee: Forenade Fabriksverken, Eskilstuna, Sweden

[22] Filed: Oct. 8, 1975

[21] Appl. No.: 620,880

[52] U.S. Cl. ..... 60/521; 60/660; 290/2; 290/40 B

[51] Int. Cl.[2] ..... F02G 1/06

[58] Field of Search ..... 60/521, 522, 660, 664, 60/665; 290/2, 40 B

[56] References Cited

UNITED STATES PATENTS

| | | | |
|---|---|---|---|
| 3,397,533 | 8/1968 | Steiner et al. | 60/521 |
| 3,527,049 | 9/1970 | Bush | 60/521 |
| 3,699,770 | 10/1972 | Bennethum | 60/521 |

*Primary Examiner*—Allen M. Ostrager
*Attorney, Agent, or Firm*—Laurence R. Brown

[57] ABSTRACT

A hot gas engine uses inexpensive digital solenoid type control valves to govern engine output as a function of the amount of working gas. Electrical control signals are obtained by comparing a generator voltage derived from engine speed with a control voltage to develop a set of control signals including pulse width modulated pulses which are open over a duty cycle which produces the effect of analog solenoid valve control.

7 Claims, 2 Drawing Figures

POWER CONTROL DEVICE

This invention relates to a power control device for maintaining a predetermined speed of a hot gas engine irrespective of the engine load and of the type in which the power output from the engine is governed by adjusting the amount of working gas in said engine.

It is known in the art that the power output of a hot gas engine may be controlled by varying a. the temperature drop in the engine,
b. the phase angle between compression and expansion of the working gas charge,
c. the effective piston stroke — controlled by the size of a variable volume gas storage space,
d. the amount of the gas in the working gas charge.

The last one of the above mentioned solutions has many advantages, e.g. a high degree of efficiency even at part loads, but it will generally call for a rather complicated and expensive system of pumps and valves.

The present invention has as one object to provide a power control system governing the amount of working gas wherein expensive valves performing analogue movements are avoided.

According to the present invention this generator supplies a voltage as a function of the engine speed, so that a comparing device can produce signals according to the difference beween the actual engine speed and the desired speed. A pulse modulator responsive to the comparing device produces signals to solenoid valves which control the supply of working gas to the engine, the withdrawal of working gas from the engine and establishing of direct connection between the spaces in the engine separated by its pistons.

Figure 1:
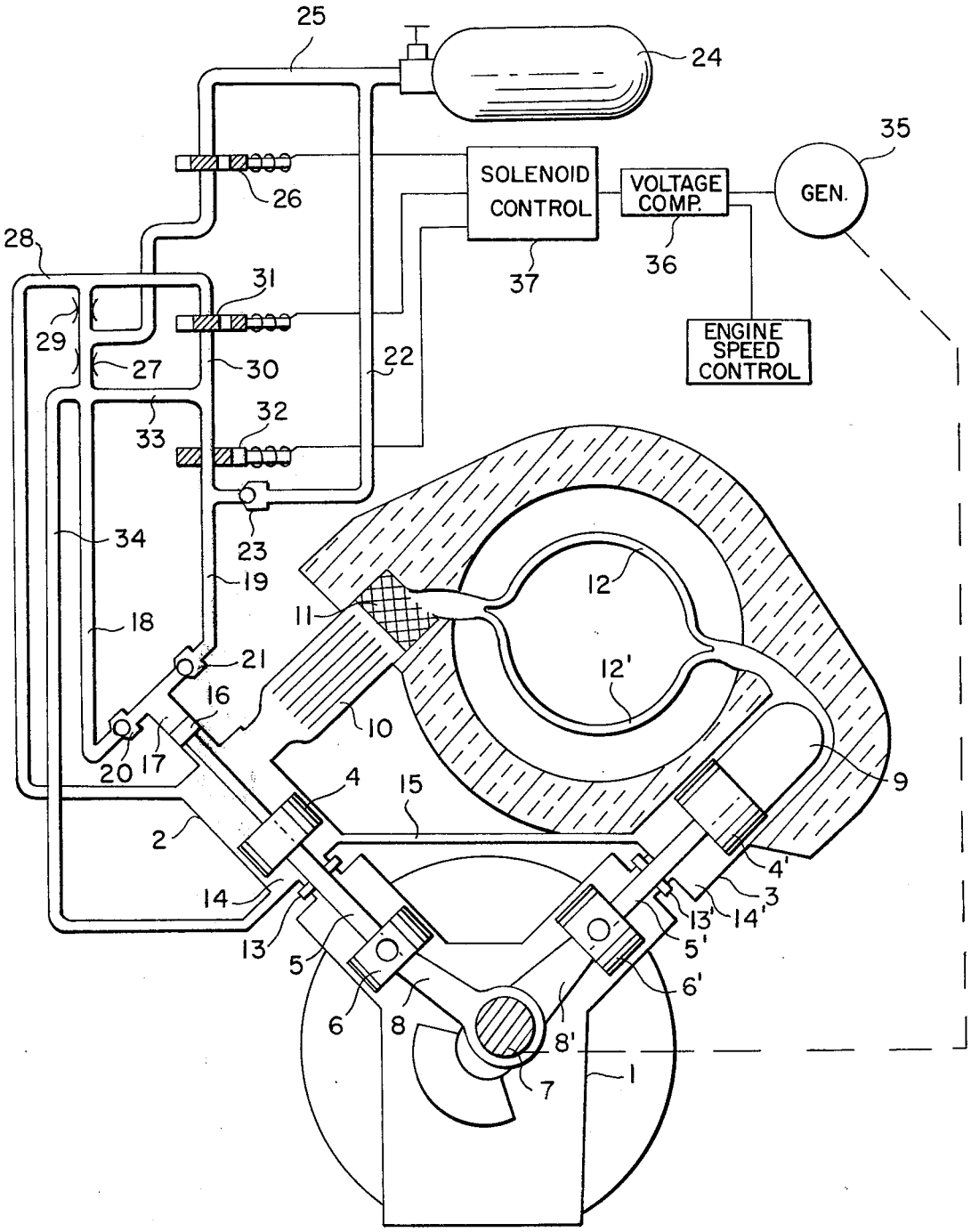

The invention will be described in more detail reference being made to the drawing showing schematically in FIG. 1 a hot gas engine provided with a power control device according to the invention, and in FIG. 2 a representative solenoid control circuit.

The hot gas engine shown comprises a crank casing 1 carrying a low temperature cylinder 2 and a high temperature cylinder 3. In each of said cylinders 2, 3 a piston 4 carrying a piston rod 5 and a cross head 6 is slidably mounted and connected to a crank shaft 7 by a connecting rod 8. The piston 4 located in the high temperature cylinder 3 is provided with a dome 9. The phase angle between the movements of the pistons 4 is 90°.

A charge of working gas such as hydrogen or helium is limited by the upper sides of the pistons 4, the upper ends of the cylinders 2, 3, a cooler 10, a regenerator 11 and a number of arcuately shaped heater tubes 12 connecting the upper end of the regenerator 11 to the upper end of the high temperature cylinder 3. The heater tubes are heated by a burner not shown in the drawing.

The piston rods 5 are passed through bottoms provided with sliding seals 13 at the lower ends of the cylinders 2, 3. Variable volume chambers 14 limited by the pistons 4 and the lower ends of the cylinders are interconnected by a pipe 15 and contain gas of a pressure substantially corresponding to the prevailing mean pressure of the working gas in the engine. Thus, the piston rings (not shown) of the pistons 4 are only exposed to the variations of pressure of the working gas. Also the cross heads 6, the connecting rods 8 and the crank shaft 7 will only be exposed to the difference between the forces acting upon the two sides of each of the pistons 4.

During operation of the engine heat is continuously supplied to the heater tubes 12 and continuously withdrawn from the cooler 10. The working gas charge is compressed at a low temperature in the cylinder 2, heated in the regenerator 11 and in the tubes 12 and allowed to expand at a high temperature in the cylinder 3.

The upper end of the piston 4 in the low temperature cylinder 2 is provided with a plunger 16 reciprocating in a pump cylinder 17. The upper end of the pump cylinder 17 is provided with inlet and outlet pipes 18, 19 governed by non-return valves 20 and 21 respectively.

A pipe 22 governed by a non-return valve 23 connects the outlet pipe 19 with a working gas reservoir 24. A pipe 25 containing a solenoid valve 26 connects the reservoir 24 with the gas inlet pipe 18, a restriction 27 being inserted in the pipe connection.

The pipe 25 also communicates with the expansible chamber inside the low temperature cylinder 2 above the piston 4, said communication being established by a pipe 28 a restriction 29 being inserted in the connection.

The pipes 19 and 28 are interconnected by a pipe 30 which is governed by solenoid valves 31 and 32. A pipe 33 connects the pipe 30 with the inlet pipe 18 and with a pipe 34 leading to the buffer space 14.

The output shaft of the hot gas engine is directly connected to a generator 35 as indicated by the dashed line, thereby giving a voltage as a function of the engine speed. Said voltage is compared with a predetermined, desired voltage in a voltage comparator 36. Dependent on the three possible alternatives (a) a correct engine speed, (b) a low engine speed, (c) a high engine speed — a solenoid control circuit 37 will act as follows:

a. Correct engine speed — constant power is desired.
   The valves 26 and 31 are closed.
   The valve 32 is open.
   (This is the situation depicted in the drawing.)
   The plunger 16 will suck in gas through the valve 20 during the suction stroke but during the following compression stroke the gas will be returned via the pipes 19 and 33 to the suction side of the pump. Thus no pumping work is performed and the mean gas pressures of the working gas, the gas in the buffer spaces and in the reservoir 24 remains constant.
   No changes in the power output will be performed.
b. Engine speed is low — power increase is desired.
   The valve 31 remains closed. The valve 32 remains fully open. The valve 26 is opened by a pulse signal, the opening time duty cycle being in proportion to the degree of desired power increase.
   (Corresponding to a partial opening of valve 26.)
   The plunger 16 still does not do any pumping work except from circulation of gas in the pipes 18, 19, 33.
   Gas is delivered from the reservoir 24 via the pipe 25 to the pipes 28 and 34 and thus into the cylinder 2 at both sides of the piston 4. Therefore the amount of working gas in the hot gas engine will increase causing a proportional increase in power output. In order to relieve the crank shaft 7 the connecting rods 8, and the cross heads 6 of the increased mechanical stresses, the pressure in the buffer spaces 14 is simultaneously increased.
c. Engine speed is high — decrease of power output is desired.

The valve 26 is closed. The valves 31 and 32 are opened by pulses during time intervals depending on the magnitude of the error signal.

The plunger 16 now pumps gas from the working gas charge in the engine as well as from the buffer spaces 14 into the reservoir 24. This is done at a predetermined rate corresponding to the engine speed, the capacity of the plunger 16 and the actual gas pressures and error signal.

The valve 31 governs a short circuit giving direct connection between the two sides of the piston 4 causing a rapid decrease in power output. Thus the power output will decrease due to the braking effect of the pumping work done by the plunger 16 — the decreasing amount of working gas — and the short circuiting of the two sides of the piston 4 the latter method of decreasing power having a controllable and rapid effect.

d. When it is desired to shut off the engine completely the heating of the pipes 12 is stopped and all the valves 26, 31 and 32 are closed.

The hot gas engine will continue to operate due to the residual heat in the pipes 12 and their surroundings.

However, gas from the working cycle and the buffer spaces will now be pumped into the reservoir 24. A normal mean gas pressure during operation of the engine may be as high as 15 MPa, but this pressure may be decreased to e.g. 2 MPa during the periods when the engine is not running. It will be understood that the normal life time of the sealing devices involved in the engine design will be substantially increased by this decrease in gas pressure.

The pulse modification is described as being effected by varying the proportion between the time period of a fully closed valve position and the time period of a fully open valve position during each pulse of a series of pulses of equal length. (Pulse width modulation).

The pulse modulation may alternatively be effected by varying the time intervals between pulses of equal length, the valve being fully open during each pulse and closed during the intervals. (Pulse frequency modulation).

The international unit of pressure is pascal (Pa). One Pa corresponds to 1 newton per square meter or 0.145 $\times 10^{-3}$ pounds force per square inch.

Figure 2:
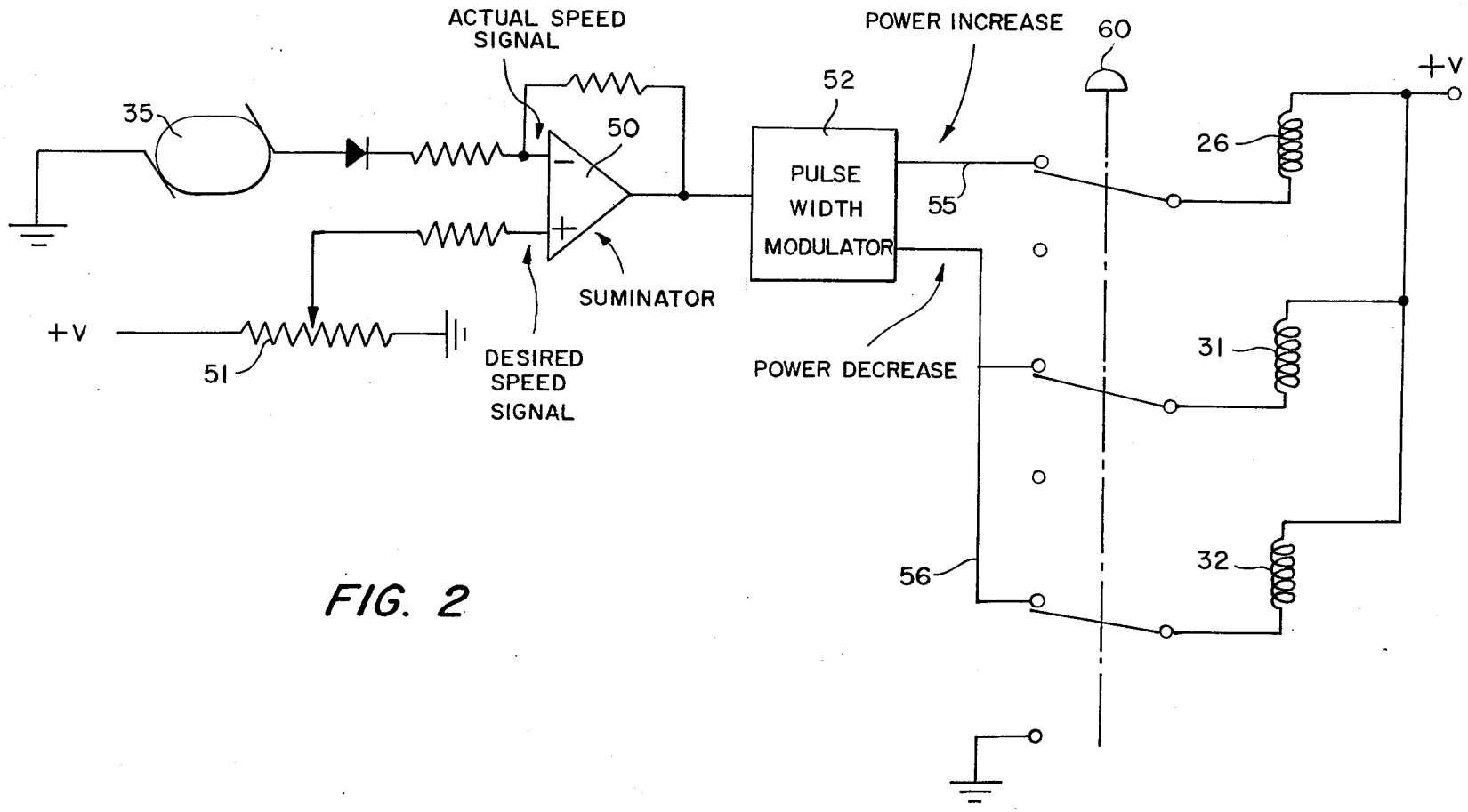

Referring to FIG. 2 the generator 35 driven by the engine will give a signal corresponding to the actual speed. This signal is rectified and delivered to a summator 50. Said summator is also fed with a voltage signal delivered by a speed setting device 51. The summator delivers a signal which is an amplified sum of the two input voltages and said amplified signal is fed to a pulse width modulator 52 of known type. E.g. such pulse width modulator has been used in connection with Stirling engines as described in the U.S. Pat. No. 3,798,901 (describing a fuel regulating device). If the output signal from the pulse width modulator is to govern a power increase the upper channel 55 from the modulator will activate the energizing coil of the valve 26 which will be opened (time modulated).

If the output signal from the pulse time modulator is to govern a power decrease the lower channel 56 will cause a modulated opening of the valves 31 and 32 while the valve 26 is closed.

A manually depressing of the switch 60 performed when the engine is to be stopped will cause a closing of all the valves 26, 31 and 32. The engine — still running — will now lower the gas pressure in the working chambers while pumping the working gas back into the reservoir.

What is claimed is:

1. A power control device for maintaining a predetermined speed of a hot gas engine irrespective of the engine load and of the type in which the power output from the engine is governed by adjusting the amount of working gas in said engine, characterized by a generator supplying a voltage as a function of the engine speed, a comparing device giving signals according to the difference between the actual engine speed and the desired speed, and control means giving signals to a solenoid valve arrangement for controlling the supply of working gas to the engine from a reservoir.

2. A power control device as defined in claim 1 in an engine having gas spaces on opposite sides of pistons wherein three solenoid valves are provided respectively (a) for controlling gas flowing to the engine from said reservoir, (b) for controlling gas flowing to said reservoir from said engine and (c) for establishing a direct connection between said gas spaces.

3. A power control device as defined in claim 2 including a solenoid valve and parallel pipes from a gas supply to said gas spaces controlled by said valve, wherein restrictions are placed in said parallel pipes.

4. A power control device as defined in claim 1 wherein said control means for said solenoid valve arrangement provides an on-off duty cycle proportional to said difference between actual and desired speeds.

5. A power control device as defined in claim 4 wherein said comparing device produces from said control means electric pulses of variable pulse width in response to said differences and a solenoid valve is controlled by said variable pulse widths in an on-off fashion to produce the effect of analog valve control.

6. A power control device as defined in claim 2 wherein said engine drives a pump system adapted to pump gas from said engine to said reservoir in response to signals from said control means.

7. A power control device as defined in claim 1 wherein said comparing device comprises a generator driven by said engine to establish a voltage dependent upon engine speed.

* * * * *